US009893453B2

(12) United States Patent
Cox

(10) Patent No.: US 9,893,453 B2
(45) Date of Patent: Feb. 13, 2018

(54) ELECTRICAL CONNECTOR

(71) Applicant: Voltrics Ltd, Birmingham (GB)

(72) Inventor: Gregory Simon Cox, Birmingham (GB)

(73) Assignee: Voltrics Ltd., Birmingham, West Midlands (GB)

( * ) Notice: Subject to any disclaimer, the term of this patent is extended or adjusted under 35 U.S.C. 154(b) by 0 days.

(21) Appl. No.: 15/326,088

(22) PCT Filed: Jul. 15, 2015

(86) PCT No.: PCT/IB2015/055346

§ 371 (c)(1),
(2) Date: Jan. 13, 2017

(87) PCT Pub. No.: WO2016/009365

PCT Pub. Date: Jan. 21, 2016

(65) Prior Publication Data

US 2017/0214203 A1 Jul. 27, 2017

(30) Foreign Application Priority Data

Jul. 15, 2014 (GB) ..... 1412539.7

(51) Int. Cl.

| | |
|---|---|
| ***H01R 13/24*** | (2006.01) |
| ***H01R 41/00*** | (2006.01) |
| ***H01R 24/58*** | (2011.01) |
| ***H01R 24/62*** | (2011.01) |
| ***H01R 35/04*** | (2006.01) |
| ***H01R 39/28*** | (2006.01) |
| ***H01R 39/12*** | (2006.01) |

(52) U.S. Cl.
CPC ..... *H01R 13/2478* (2013.01); *H01R 13/2485* (2013.01); *H01R 24/58* (2013.01);
(Continued)

(58) Field of Classification Search
CPC ..... H01R 13/2478; H01R 13/2485; H01R 39/28; H01R 39/12
(Continued)

(56) References Cited

U.S. PATENT DOCUMENTS 3,328,741 A 6/1967 Brown
4,475,779 A * 10/1984 Fohl ..... B60R 16/027 439/131

(Continued)

FOREIGN PATENT DOCUMENTS

| | | |
|---|---|---|
| GB | 302012 | 12/1928 |
| JP | H01258535 A | 10/1989 |
| KR | 2003-0040804 A | 5/2003 |

OTHER PUBLICATIONS

Notification of Transmittal of the International Search Report and the Written Opinion of the International Searching Authority, or the Declaration, PCT/IB2015/055346, Oct. 5, 2015, 13 pages.

*Primary Examiner* — James Harvey
(74) *Attorney, Agent, or Firm* — Myers Bigel, P.A.

(57) ABSTRACT

The present invention relates to an electrical connector in particular an electrical connector having at least two terminals that are connected wherein the electrical connector permit movement of each terminal relative to each other. The electrical connector has a first body part having a first terminal; the first terminal is connected to a second terminal formed in a second body part, the first and second body parts are connected together and can move with respect one to another thereby permitting variable angles to be created between an axis defined by the first terminal and an axis defined by the second terminal.

24 Claims, 11 Drawing Sheets

(52) U.S. Cl.
CPC ..... *H01R 24/62* (2013.01); *H01R 35/04* (2013.01); *H01R 39/12* (2013.01); *H01R 39/28* (2013.01); *H01R 41/00* (2013.01)

(58) Field of Classification Search
USPC ..... 439/8, 17
See application file for complete search history.

(56) References Cited

U.S. PATENT DOCUMENTS 4,558,911 A * 12/1985 Ruoff ..... B25J 9/104 338/79
4,953,223 A * 8/1990 Householder ..... F16M 11/24 381/182
6,695,620 B1 * 2/2004 Huang ..... H01R 13/562 439/11
7,234,963 B1 6/2007 Huang
8,120,895 B2 * 2/2012 Zeller ..... B60R 16/027 361/679.01
2003/0040205 A1 * 2/2003 Scheider ..... H01R 24/58 439/125
2012/0028505 A1 2/2012 Weber et al.
2013/0108098 A1 5/2013 Qin
2015/0093917 A1 * 4/2015 Stern ..... B25J 9/065 439/8
2016/0164234 A1 * 6/2016 Li ..... H01R 24/58 439/669
2017/0214203 A1 * 7/2017 Cox ..... H01R 41/00

* cited by examiner

ELECTRICAL CONNECTOR

RELATED APPLICATIONS

This application is a 35 U.S.C. § 371 national stage application of PCT Application No. PCT/IB2015/055346, filed on Jul. 15, 2015, which claims priority from Great Britain Patent Application No. 1412539.7 filed on Jul. 15, 2014, the contents of which are incorporated herein by reference in their entireties. The above-referenced PCT International Application was published in the English language as International Publication No. WO 2016/009365 A1 on Jan. 21, 2016.

FIELD OF THE INVENTION

The present invention relates to an electrical connector in particular an electrical connector having at least two terminals that are connected wherein the electrical connector permit movement of each terminal relative to each other.

BACKGROUND

Electronic devices such as portable mp3 players or smartphones with data and music storage and playback options are popular and commonly used devices. A user listens to the audio from their device via a pair of headphones or ear buds that are connected to the device via a cable, or connect the device to speakers or a computer or laptop, the cable terminating in a jack or connector that plugs into a socket in the device.

It is common for the cable to be moved in various directions whilst setting up and/or during use. In addition a user may wrap the cable around the device for storage convenience when they are not using the device, to prevent it from trailing and snagging on other items. A user normally leaves the jack still connected into the socket when they wrap the cable, and almost invariably, as the cable is wrapped around the body of the device the cable pulls on the jack body and exerts a force at a sideways angle to the body and the cable connection. Frequently, this causes damage to the plug, socket and/or the cable connection and can render the device unusable. This is inconvenient and expensive.

The present invention arose in order to overcome the aforementioned problems and provides an electrical connector that permits variable movement whilst maintaining an electrical connection.

PRIOR ART

Korean Patent Application KR 20030040804 (Jean) describes and shows an audio plug intended to prevent loose contact by having a freely moving terminal part that prevents the audio plug from being pulled out from a jack. A ball base is fixed at a rear end of a terminal part.

A rotary base supports the ball base and has integrated holders formed from four point parts in rounded shapes. A guide is formed between the holders to rotate the terminal part within the rotary base according to a rotation of the ball base. A groove is formed at one side of the rotary base for inserting an additional accessory.

United States Patent Application US 2013/0108098 (Qin) describes and shows an earphone that includes a headset plug and an earphone cord connecting to the headset plug. A protector is located around the junction of the headset plug and the earphone cord. The protector includes a fastening member secured to the headset plug, and a rotary member located around the earphone cord and assembled to the fastening member, so that the rotary member can rotate relative to the fastening member with the earphone cord when the earphone cord is bent.

U.S. Pat. No. 7,234,963 (Huang) describes and shows a USB connector with orientation adjustment comprising a top cover, a connector seat with a cable slot, a cable rotating seat, cable and a bottom cover. The top cover is engageable with the bottom cover enclosing the connector seat and the cable rotating seat.

UK Patent Application GB 2 302 012 (Harden) discloses a ball having contacts round the circumference and a contact at the base, these contacts engage with contacts in the socket to provide an electrical connection.

The present invention provides a moveable electrical connection to accommodate various uses and storage options without causing damage to the terminals or compromising the electrical connection.

SUMMARY OF THE INVENTION

According to a first aspect of the present invention there is provided an electrical connector, comprising: a first body part having a first terminal; the first terminal is connected to a second terminal formed in a second body part, the first and second body parts are connected together and can move with respect one to another thereby permitting variable angles to be defined between an axis of the first terminal and an axis of the second terminal wherein the first body part includes at least one groove spaced around a surface thereof, the at least one groove is adapted to receive at least one conductive ball bearing, each groove being lined with a conductive material that connects to the first terminal and at least one electrical contact arranged on an inner surface of the second body part portion, said at least one electrical contact being connected to the second terminal, at least one of said electrical contacts connects with the at least one conductive ball bearing whilst located in the grooves, so as to permit an electrical connection between the first terminal and the second terminal.

In this way orientation of the terminals can be easy adjusted to accommodate the devices or system to which the terminals are connected and are requirement be arranged for optimal use, thereby providing a greater freedom of movement during use. For example the electrical connector may have a terminal adapted to receive a pair of headphones and the electrical connector permits movement of the connecting cable in plural orientations so as not to restrict movement of the user that may otherwise result in disconnection of the headphone.

Preferably the terminal is a plug or socket in this way the electrical connector is capable of being connected to an array of devices and/or systems.

In some embodiments the terminal includes a cable extending from the electrical connector having a plug or socket arranged at a distal end of the cable, thereby spacing apart the terminal connection from the electrical connector.

The electrical connector may be used to provide an audio, data or power connection.

Advantageously as the angle defined between the first and second terminals is changed the associated connected portions received by the terminals such as the cable, plug and or socket and the associated devices, such as headphones, a smartphone or any other electrical device, can be freely positioned so that the electrical connector is off-axis whilst still maintaining an electrical connection. This permits devices that have a fixed location or restricted access to be readily connected and easily maneuvered with reduced likelihood of damage.

The first and second body parts comprising a male ball portion and female socket portion provide a simple mechanism which is easy to produce and which can be formed in suitable sizes and shapes.

Preferably the first body part may comprise the male ball portion and the second body part may form the female socket portion configured to partially envelop the male ball portion when connected.

Ideally the female socket portion has a smooth, planar rim that defines an edge to which the terminal arranged on the male ball portion can abut in use thereby defining the boundary of range of movement permitted by the electrical connector.

In some embodiments the rim may include recessed sections adapted to receive the terminal, cable, plug and/or socket arranged on the male ball body so as to permit a greater range of movement in predefined directions. Therefore the rim may include at least one undulation.

In some embodiments the recessed section may include an insert formed from a resiliently deformable material such as an elastomer which deforms to accept the terminal so as to provide a securement means that prevents the terminal from unintentional removal.

In yet further embodiments an inner face of the recessed section may include resiliently deformable nubs which deform to permit the terminal to enter the recess. Therefore holding the terminal in the recess until a force is replied to pass the terminal out pass the nubs.

The first and second body parts are configured to move in a similar manner to a constant-velocity joint such as a Rzeppa (RTM) joint, so as to permit constant movement whilst present invention also provides a means maintaining an electrical connection. Such mechanisms can be suitably adapted for this use and allow free rotation with unbroken contact.

Typically the electrical connector may include at least four ball bearings and four corresponding electrical connector grooves in order to permit audio, power or data transmission.

It may be envisaged that the number of ball bearings and grooves can be scaled up or down in order to accommodate different electrical connections for example permitting the electrical connector to be suitable for power cables.

In a preferred embodiment the electrical connector may have eight conductive ball bearings. This number has been found to provide optimal rotational and contact qualities.

In preferred embodiments the male ball portion comprises a plurality of grooves spaced around an outer face thereof for receiving at least one conductive ball bearing.

Typically each groove extends from the terminal longitudinally along part of all of an arc of the male ball portion.

In some embodiments the grooves may be arranged to extend latitudinal or radially, so as to permit rotation about an axis of the terminal. For example to enable the plug, socket and/or cable to swivel.

In such embodiments the socket portion may comprise a tube arranged about cylindrical ball portion so that the tube can rotate about the cylindrical ball portion.

Each groove is lined with a conductive material that connects to the first terminal so as to permit connection to the terminal by means of the conductive ball bearing. Typically the conductive material is attached the terminal by means of a pin that passes through the wall of the male ball portion to a cavity within where a wire connects the pin to the terminal. Typically the wire is connected to the solder pin by soldering.

At least one electrical contact is arranged on an inner face of the female socket section. The at least one electrical contact is connected to the second terminal to permit connection with the conductive ball bearing and therefore connection between the first terminal to the second terminal. In use the at least one contact is capable of connecting with one or more of the conductive ball bearings whilst located in the grooves so as to permit a constant electrical connection from the first terminal to the second terminal.

Each groove may be lined with a conductive strip of metal or may be plated in a conductive material so as to provide a connection with the terminal. For example the male ball portion may further comprise a plurality of elongate electrical strips, each groove and electrical strip may be mutually configured so that the strip fits within the groove. This configuration provides a suitable contact and rotation configuration with high reliability and ease of manufacture.

Typically the lining of each groove is linked to a pin such as a solder pin that passes to a central region (cavity) of the male ball portion that contains wiring associated with the terminal.

Ideally the male ball portion may be formed as two halves that are fitted together. The grooves may be lined after the two halves are connected so as to ensure the conductive material provides a continuous layer for the ball bearing to travel along for an improved connection. Advantageously this permits access to parts within the cavity during manufacture and fabrication.

Preferably a pair of grooves may be linked together so that one pin may be used to connect two grooves to the terminal. Typically two grooves may be linked at one end wherein the pin is arranged at the joining section. For example the two grooves may be arranged in a U-shaped or V-shaped configuration.

The arrangement of the ball bearings in the grooves enables movement of the first and second body parts relative to each other wherein rolling of the ball bearings permits movement of each ball bearing along a groove in which it is located and also permits the electrical contact to move over the ball bearings so as to permit movement in plural directions that enables the terminals to be at various angles relative to one another whilst maintaining a constant electrical connection by means of the ball bearing.

In some embodiments the female socket portion further comprises a contact crown comprising a plurality of elongate electrical contacts, each corresponding to a groove, and at least one conductive ball bearings arranged in each groove which can freely move along the length of the groove that in use is arranged between a groove and an electrical contact so as to provide an electrical connection that is maintained during movement of either of the parts.

The contact crown may comprise a ring arranged about the terminal from which each of the elongate electrical contacts extends.

In some embodiments the ring may connect to a corresponding annular groove on the make ball portion so as to permit rotation whilst maintaining an electrical connection.

In some preferred embodiments a pair of elongate electrical contacts may be linked together so that a single pin is provided for connection of both contacts to the terminal. The pair of electrical contacts may be configured as U-shaped or V-shaped.

In some other embodiments the electrical connector may have one electrical contact comprising a substantially hemispherical dome that covers the inner face of the female socket portion so as to provide a single electrical contact that can engage with all ball bearings.

Preferably the electrical contact(s) is/are sprung so as to be biased against the ball bearing in use therefore aiding in maintenance of a constant connection. Advantageously this may improve quality of the connection to ensure the connection is not broken during movement.

In the case of the elongate electrical contact the contact is attached to the electrical connector at a proximal end and the distal end is free. Typically the elongate electrical contact is to be arranged to be biased towards to the ball bearing in use so that the elongate electrical contact must be displaced slightly in order to accommodate the ball bearing and is therefore forced into constant contact with ball bearing during use.

In the case of the contact being a shell a rear face of the shell that interfaces the female socket portion may include spring means so as to bias the shell towards the ball bearings in use.

In some alternative embodiments the grooves and electrical contact may be provided in a reverse arrangement wherein the grooves are provided on an inner face of the female socket and the electrical contact(s) is/are provided on the male ball portion wherein the ball bearings run in the grooves that are provided.

In some embodiments the grooves for receiving the ball bearings only extend along one hemisphere of the ball joint.

In other embodiments the conductive ball-bearing(s) may be located in a recess(es) that allow free rotation so as to maintain the ball-bearing in a fixed position on the electrical connector. For example recesses may be provided on an outer face of the male ball portion so as to engage with electrical contacts arranged on the female socket portion.

In some embodiments each ball bearing may be held in a recess whilst still permitting the ball bearing to run along a groove in response to movement of the parts relative to each other. Advantageously in this way if the grooves may be arranged on an inner face of the female socket portion and the ball bearings are arranged within recesses provided on the male ball portion so it may be possible to keep the grooves concealed and therefore protected within the constant velocity joint. Therefore the electrical connection is protected during use. This may improve longevity of the electrical connector and furthermore improves safety.

In preferred embodiments the electrical connector is a sealed unit having a protective outer layer. In this way all component parts are protected to prevent damage and ingress of dust or moisture that may compromise the electrical connection. Preferably the protective outer lay is flexible so as to easily deform during movement in order to not restrict movement. For example the protective outer layer may be formed from rubber.

Ideally the protective outer layer is connected to the rim of the female socket portions.

In preferred embodiments the ball and socket portions are made from a lightweight, strong durable material such as synthetic plastic. Ideally all the plastic components may be injection moulded with an electromagnetic shielding to protect the system from interference.

Some examples of the terminal include a headphone plug, headphone socket, Universal Serial Bus (USB) plug, USB socket, Deutsches Institut fur Normung (DIN) plug or socket.

The headphone jack may be a 3.5 mm jack plug. This is a standard size for portable audio devices.

The plug connector may comprise a USB plug. This provides an alternative type of connection.

In a preferred embodiment the diameter of the electrical connector is at least 7.5 mm and in some more robust embodiments may be at least 10 mm. It is appreciated that the electrical connector may be scaled up or down depending upon requirements and the type of connection.

In some embodiments the electrical connector may include a locking mechanism to prevent movement between the body parts. In this way the body parts can be arranged in a particular configuration and then locked in position so as to prevent movement in use.

For example the socket may include a displaceable projection that can be extended from an inner face of the socket so as to engage with a ball portion in order to prevent movement.

In some embodiments the conductive grooves/tracks allow the conductive ball bearings and one terminal to move along a linear path, thereby permitting radial movement in one plane. An example of this embodiment is described below wherein the ball and socket portions may be substantially hemispherical.

In such embodiments the socket portion may include an elongate channel along which one moveable terminal can pass, so that the ball and socket portions remain static in use and the moveable terminal moves along the channel whilst being engaged with the grooves and electrical contact at different positions along the channel. Typically the other terminal is non moveable being at a fixed position on the electrical connector and connected to a device, such as a smart phone in use, so that one terminal is fixed and the other terminal is moveable along a channel in one plane.

In this embodiment the ball and socket portions do not move relative to each other and instead the moveable terminal is arranged in a channel that permits movement by means of the electrical connector and thereby enables the moveable terminal to be provided at various angles relative to a central axis defined by the non-moveable terminal.

The moveable terminal is configured to be in contact with the electrical contact whilst being moveable along the channel therefore maintaining an electrical connection between the first and second terminals.

In some embodiments the electrical contact arranged on an inner face of the socket is moveable and includes terminal wires embedded therein.

In another embodiment the wire is moveable such that the wire(s) is/are arranged to remain in contact with the electrical contact during movement so as to provide a constant connection. For example the electrical connector may comprise a member arranged in use between and in contact with the electrical contact and the ball bearings, wherein wires from the moveable terminal are embedded in the member. In this way the member is sandwiched between the ball bearings and electrical contact in order to permit an electrical connection between the first and second terminals.

In preferred embodiments the wire ends may be shaped as a hook so as to cup a ball bearing at each edge of the member. Typically the hooks at each end correspond with a groove provided on the ball portion. In this way two ball bearings are engaged with the member at any one time and as the moveable terminal is moved so do the ball bearings.

Typically the member may have a plurality of wires associated with it so that multiple connections can be made with plural ball bearings thereby improving electrical transmission.

In some embodiments the wire(s) or member may comprise the electrical contact.

In yet further embodiments the wire of the terminal may be sandwiched between layers of the electrical contact providing a moveable conductive member that is in contact with at least one conductive ball bearing.

Some embodiments of the electrical connector may include filters and/or amplifiers so as to improve transmission of a signal between the terminals.

Preferred embodiments of the invention will now be described, by way of examples only, and with reference to the Figures in which:

DETAILED DESCRIPTION OF FIGURES

Figure 1:
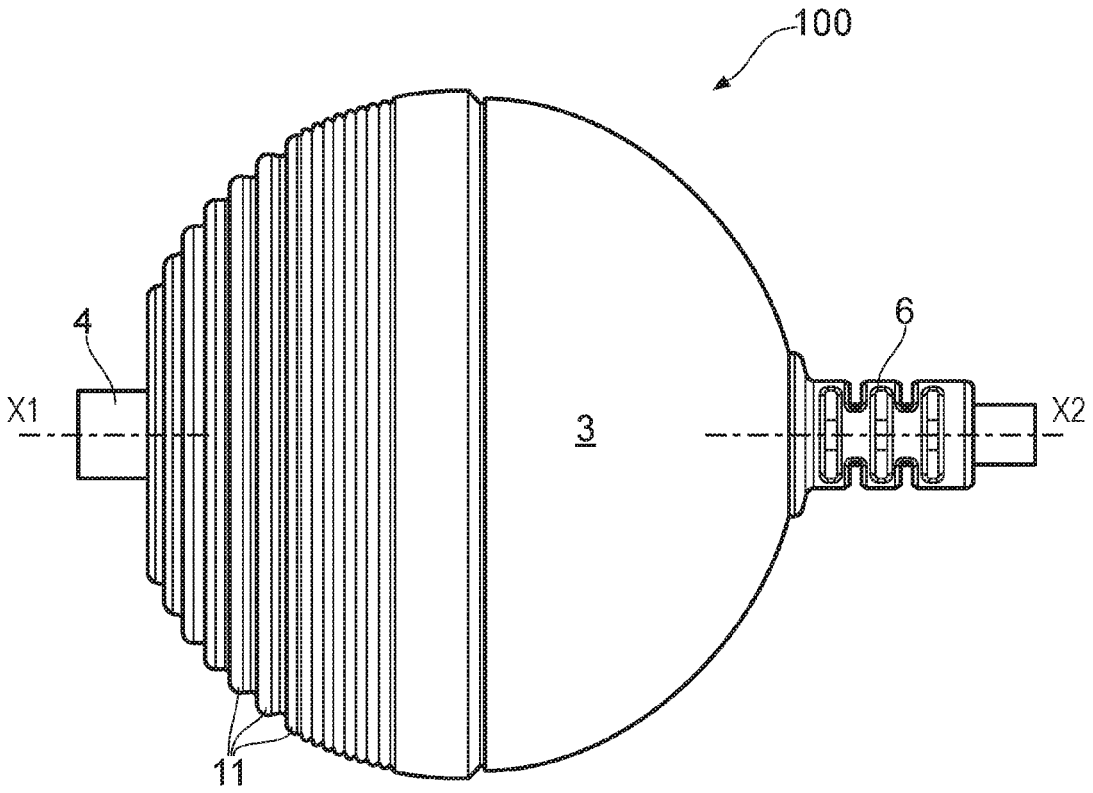
FIG. 1 shows an overview of the electrical connector having a protective outer layer.

FIGS. 1 to 5 show a preferred embodiment of the electrical connector.

The electrical connector 100 is spherical; the body formed from two parts a male ball portion (not shown) and a female socket portion 3. The female socket portion is hemispherical so as to partially encase the male ball portion.

Two terminals 4, 6 are provided on the electrical connector 100.

The female socket portion is connected to a protective outer layer 12 so as to seal the electrical connector 100. The protective outer layer is formed from rubber, having a series of concentric ridges 11 that enable the protective outer layer to readily flex and fold as the position of the terminal 4 is changed.

Figure 2:
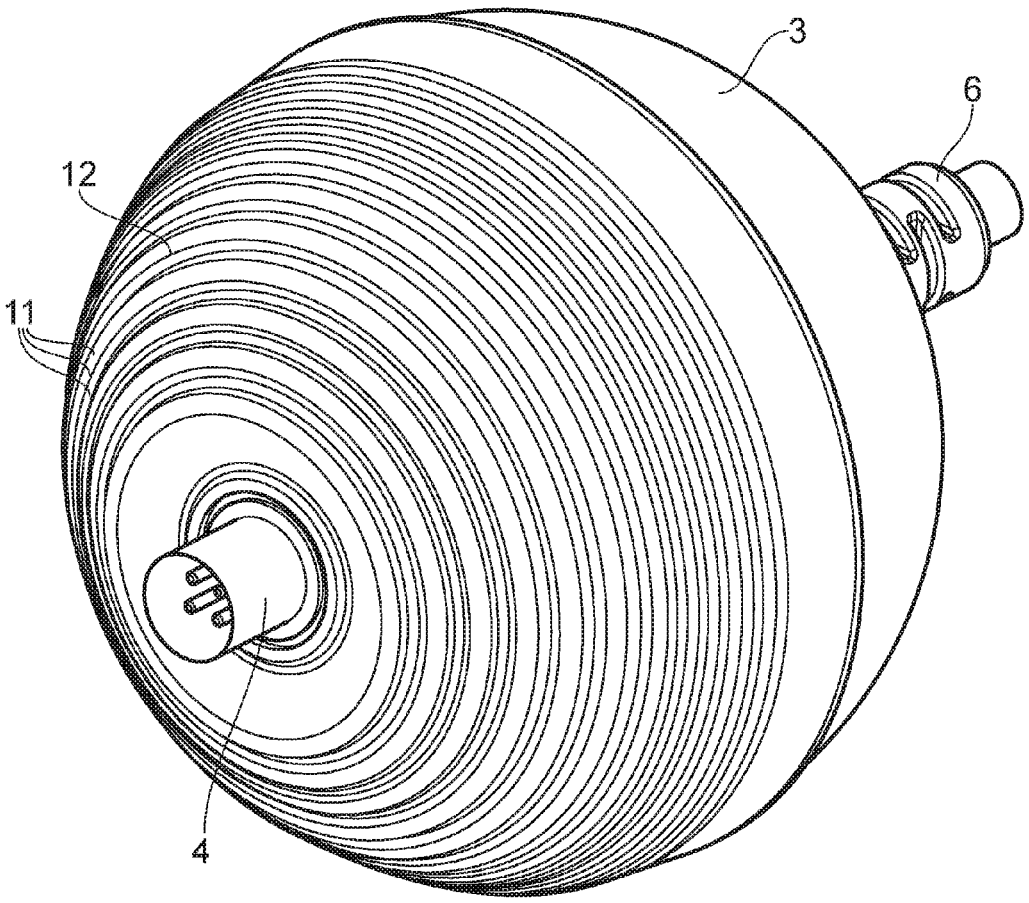
FIG. 2 shows an alternative view of the electrical connector shown in FIG. 1.

In FIGS. 1 and 2 the axis X1, X2 of terminals 4, 6 are shown arranged in the same alignment.

Figure 3:
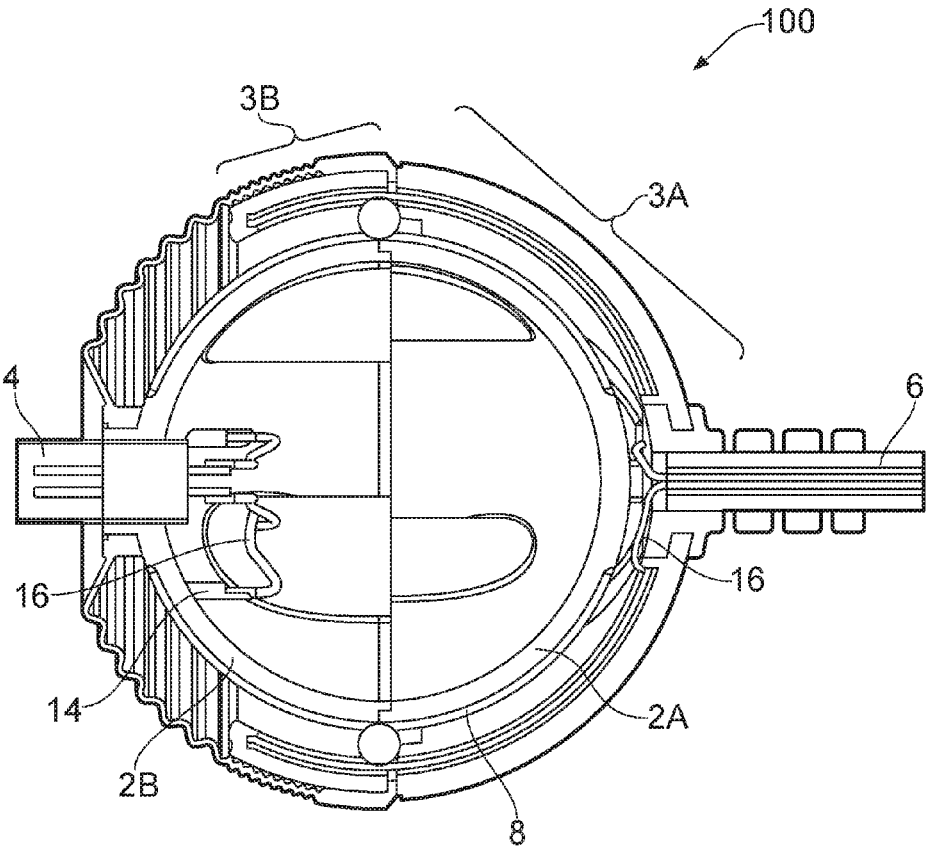
FIG. 3 shows a cross section of a preferred embodiment of the electrical connector shown in FIG. 1.

FIG. 3 shows a cross section of the electrical connector 100. The male ball portion 2 is formed from two hemispherical parts 2A, 2B. The male ball portion 2 is hollow.

An outer face of the male ball portion 2 has grooves 8 for receiving the conductive ball bearings 10. The groves 8 provide a track along which the ball bearing(s) can run.

The groove 8 is lined with a conductive material so as to permit transmission. The conductive lining is a metal strip (not shown) dimension to site within the groove 8. The conductive lining is connected to a solder pin 14 which passes through the wall of the male ball portion 2 to the hollow centre to which a distal end of the solder pin 14 extends so as to be connected by a wire 16 to the terminal 4.

The male ball portion 2 sits concentrically within a female socket portion 3. The female socket portion 3 is hemispherical and encases more than half of the male ball portion 2.

The female socket portion 3 is formed from two parts 3A, 3B so as to permit the female socket portion to be fitted about the male ball portion 2. Parts 3A and 3B are locked together in use so that the male ball portion 2 is contained.

An inner face of the female socket portion 3 has a plurality of electrical contacts 7 extending from a pole defined by terminal 6. The electrical contacts 7 are connected to the terminal by means of wiring 16.

Conductive ball bearings 10 are arranged between each groove 8 and electrical contact 7 so as to provide an electrical connection.

Figure 4:
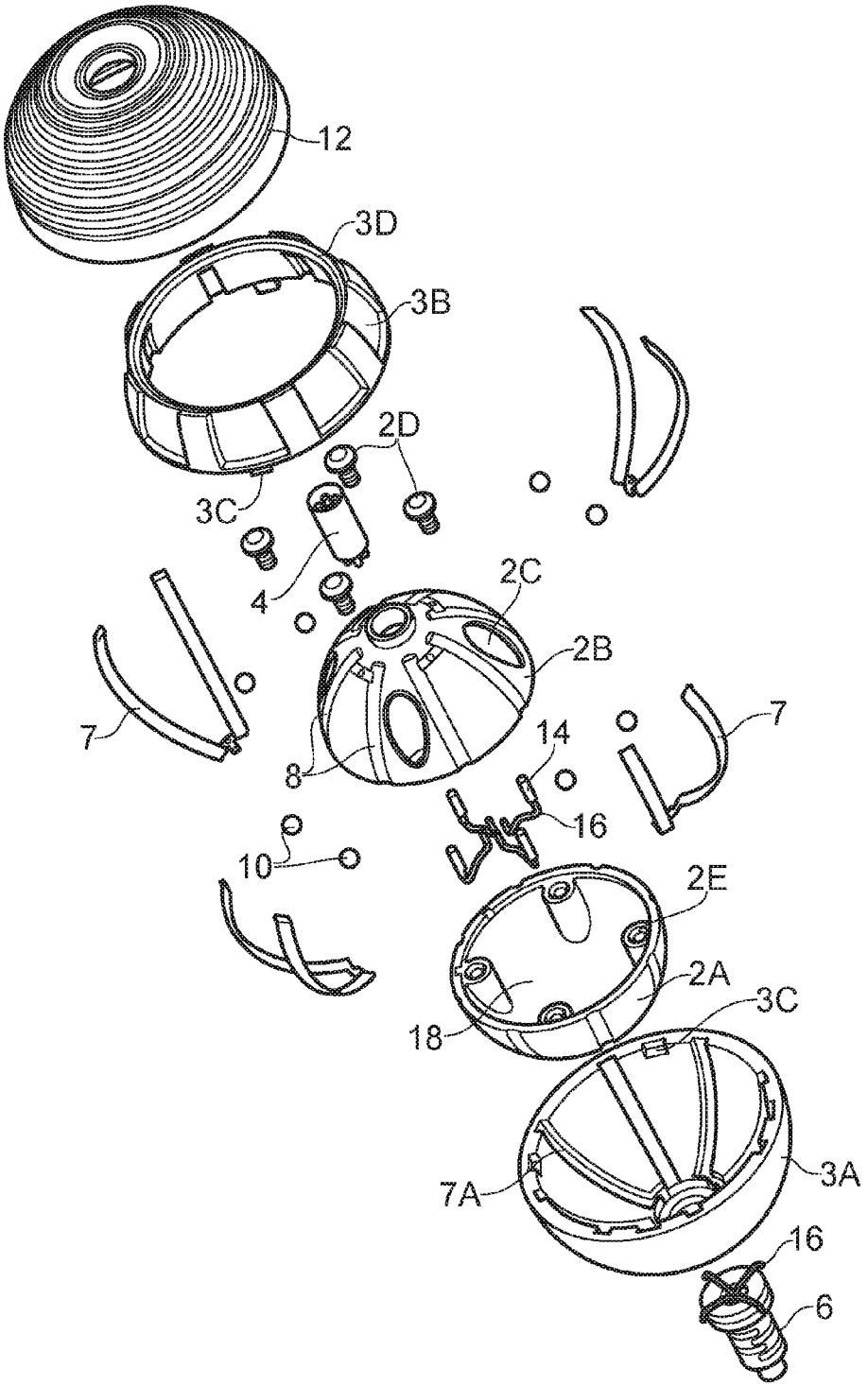
FIG. 4 shows a top exploded view of the electrical connector.
Figure 5:
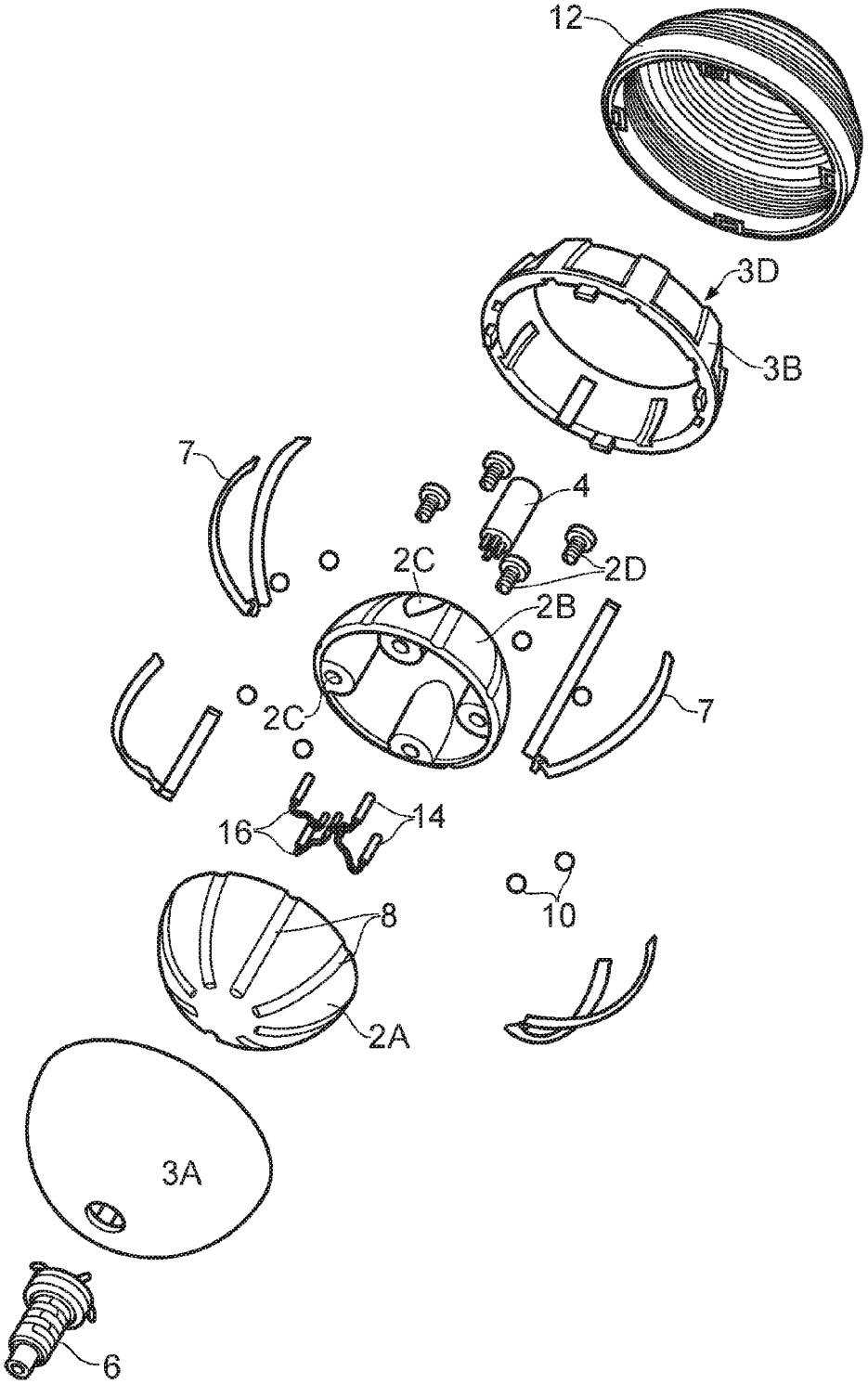
FIG. 5 shows a bottom exploded view of the electrical connector.
Figure 6:
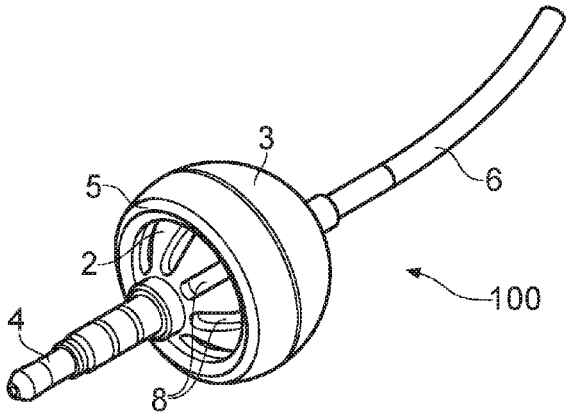
FIG. 6 shows a perspective view of a second embodiment of the electrical connector.
Figure 7:
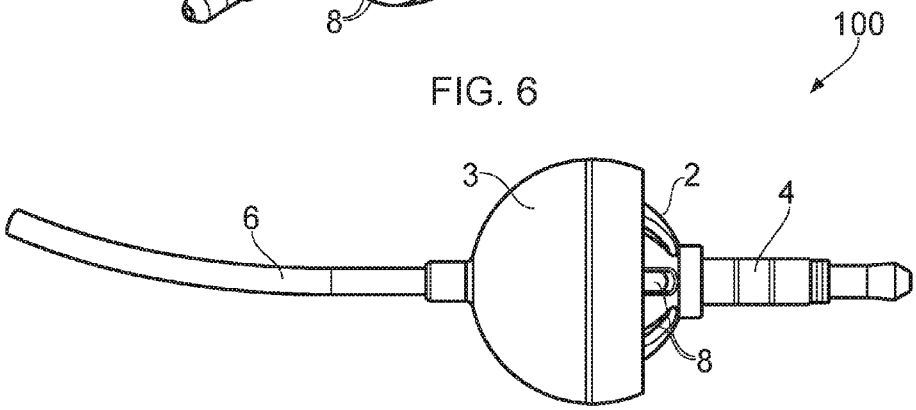
FIG. 7 shows a side view of the electrical connector plug of FIG. 6.
Figure 8:
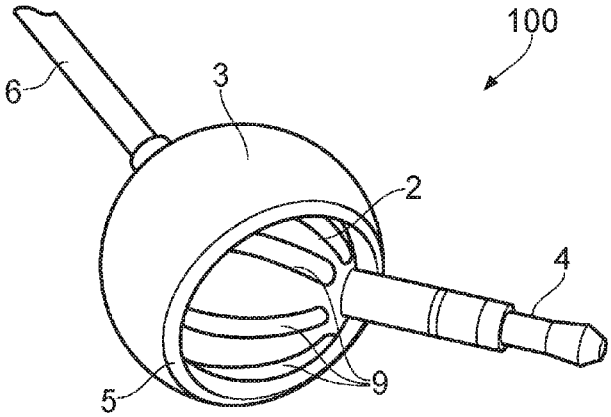
FIG. 8 shows a perspective view of the electrical connector of FIGS. 5 and 6 with the plug connector angled away from the axis of the cable end terminal.
Figure 9:
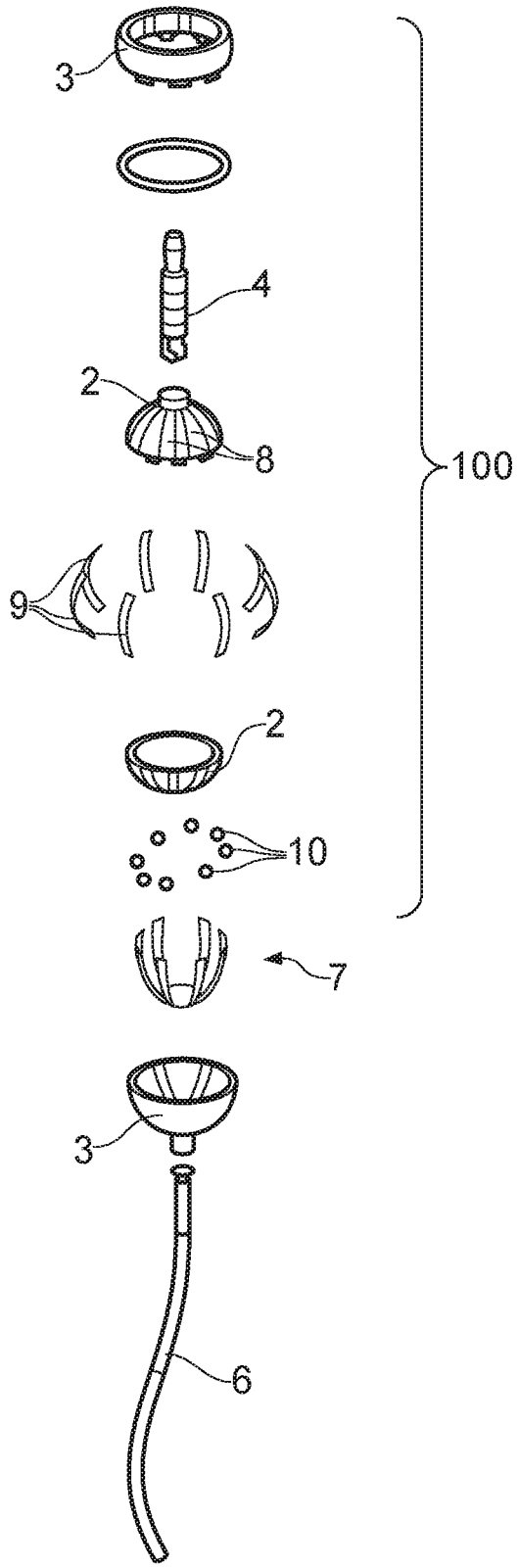
FIG. 9 shows an exploded view of the electrical connector of FIGS. 5 to 8.

FIGS. 4 and 5 show exploded views of the electrical connector 100 shown in FIGS. 1 to 3.

The male ball portion 2 is formed from two hemispheres 2A, 2B. The walls of hemisphere 2B includes attachment means in the form of four apertures 2C for receiving screw 2D that are secured in four corresponding holes 2E on hemisphere 2A. In this way the male ball portion 2 is secured in a ball formation. The two hemispheres 2A, 2B are formed from synthetic plastic and the grooves 8 are plated with a metal, alloy or metal composite to provide a conductive track.

The outer face of the male ball portion 2 includes eight grooves 8 lines with conductive material. These are arranged as four connected pairs wherein one solder pin 14 is provided to connect each pair of grooves to the terminal 4 by means of a wire 16. The solder pin 14 passes through the conductive material of the groove 8 and through the wall of the male ball portion into the cavity 18.

The female socket section 3 is formed from two parts 3A, 3B so as to be fitted about the male ball portion 2 in order to hold the ball 2 within the socket 3. The parts 3A, 3B are held together by clip means 3C. The two parts 3A and 3B are moulded from synthetic plastic.

An inner face of the socket 3 is moulded to provide channels 7A for the electrical contacts 7. There are eight electrical contacts 7 provided as four connected pairs that correspond to the eight grooves 8.

Each electrical contact pair 7 is connected to the socket 3 at a proximal end and the distal ends are free. The electrical contacts 7 are sprung so as to be biased towards the grooves 8 in use. The proximal end of each electrical contact pair 7 is connected to a wire 16 which connects to the terminal 6.

The electrical contacts 7 are formed from a conductive metal, alloy or metal composite.

Eight conductive ball bearings 10 are provided, one for each groove 8.

The range of movement permitted is determined by the socket rim 3D to which the terminal 4 abuts during use, the rim 3D forming a barrier.

The protective layer 12 connects to the socket 3 so as to form a sealed unit. In some embodiments this seal may provide be watertight so as to prevent ingress of water and therefore providing a waterproof electrical connector wherein each terminal is also provided with a watertight seal.

A second embodiment of the electrical connector is shown in FIGS. 6 to 9.

The electrical connector 100 has two main parts: a first body part 2 with the overall shape of a ball, which forms the male portion or ball portion of a ball and socket type joint, and a second body part 3 that forms a corresponding female or socket part.

The first body part 2 is configured to be fitted with a plug connector 4 so that the plug connector 4 extends from the ball. In this embodiment, the plug connector 4 is a 3.5 mm stereo audio plug. The second body part 3 is configured to receive the end of a cable in use—that is, to act as a cable terminal.

The socket portion 3 is generally spherical, but has an aperture 5 on one side. In use, the ball portion 2 is securely located within the socket portion 3, with the plug connector 4 extending out of the aperture 5. The aperture 5 is sized so that the socket extends partly around/over the ball portion 2 so that the ball portion 2 is held securely in the socket 3 and cannot drop out or be pulled free, but also so that the plug connector can move around within the aperture 5. That is, the aperture 5 is several times larger than the cross-section of the plug connector 4.

The plug connector 4 is rigidly connected to the ball portion 2 so that moving the plug connector 4 moves the ball portion 2 within the socket portion 3. The ball and socket portions 2, 3 are configured so that the plug connector 4 can be axially aligned with the cable, the socket portion 3 configured so that a connected cable 6 in use extends from the opposite side of the socket 3 to the plug connector 4.

The ball and socket connection between the ball portion 2 and the socket connection 3 allows these portions to be moved relative to one another when connected to create an angle in any direction between the axis of the plug connector 4 and the axis of the cable end terminal, with the ball portion 2 and the socket connection 3 freely rotatable fully around the axis of the plug connector and/or the axis of the cable end terminal to change the angle. That is, if a circle was located with its centre on the axially aligned axis, the circle aligned perpendicular to the axis, each of the ball portions 2 and the socket portion 3 can be freely moved towards any point on the perimeter of the circle.

As the angle can be changed between the plug connector 4 and the cable end terminal, the associated cable 6 can be freely pulled to the side or off-axis when the plug connector 4 is located in a socket or is otherwise immovable, and the likelihood of damage is reduced.

In the embodiment shown in FIGS. 6 to 9, the aperture 5 is planar, which allows free and unimpeded angular movement from one position to another.

The aperture 5 could have a waved/undulated circumference or a similar regular perimeter that allows smooth and unimpeded movement from one angle to another.

In each position, the electrical connector 100 is able to transmit the electrical audio, data or power signals from the cable through to the terminal (plug) 4. This is achieved by having the ball portion 2 and the socket connection 3 configured internally to on-transmit the electrical current, while still configured to allow the angle to be freely changed.

The socket connection 3 has a contact crown 7 comprising eight elongate electrical contacts that extend from the cable terminal connection around the inner surface of the socket 3 at regularly spaced intervals. Each has an associated conductive bearing 10 that locates onto the inner surface of each strip and which can freely move along the length of its associated electrical contact. The ball portion 2 has eight grooves 8 spaced at regular intervals around its circumference, each having an elongate electrical strip 9 that locates into each groove 8. When the ball portion 2 and the socket portion 3 are connected, the bearings 10 bridge between and create contact between the eight contacts of the contact crown 7 and the electrical strips 9. This configuration provides a suitable contact and rotation configuration with high reliability and ease of manufacture.

As described above, the plug connector 4 extends from the ball portion 2. The positions could be reversed so that the plug connector 4 extends from the socket portion 3. Also, the plug connector could be a USB plug rather than a headphone plug, or it could be any other type of plug.

Figure 10:
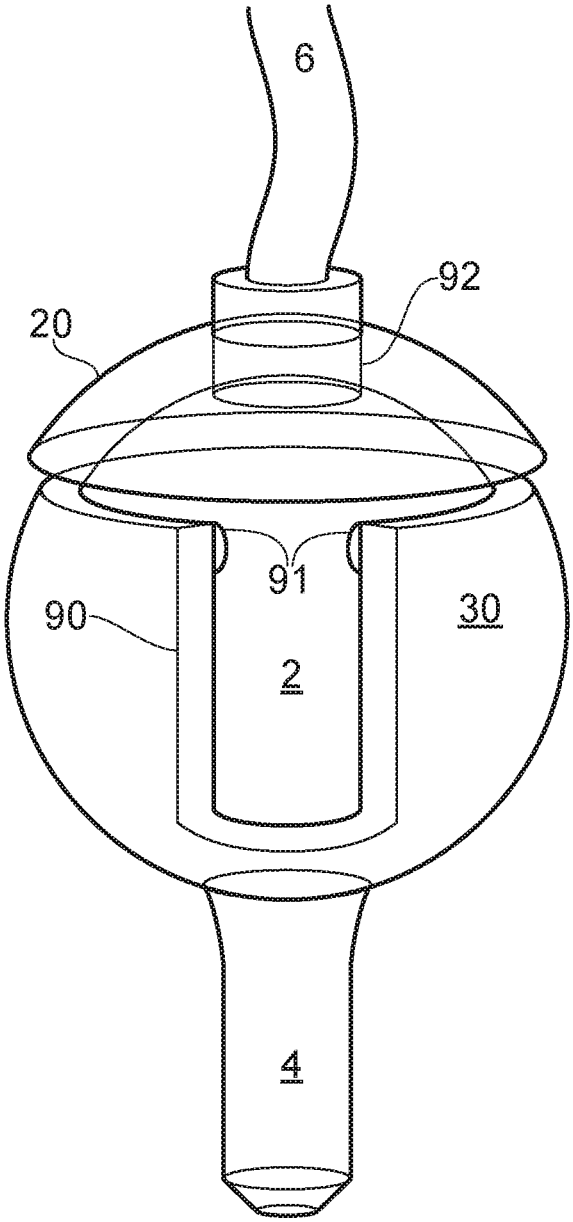
FIG. 10 shows a side view of an electrical connector having a locking slot with grips.

In FIG. 10 an embodiment of the electrical connector 100 is shown having a recessed/cut out section 90 in the wall of the socket 30. The recessed portion 90 provides a channel into which the terminal 6 can be slotted to provide a greater range of movement in one plane. In some embodiments there could be more than one recessed/cut out section 90 to form an X-shaped configuration of slots.

In some embodiments there could no recessed/cut out section 90.

The ball portion 2 is arranged in the socket portion 30 and rotates there within. An inner face of the insert 90 includes a pair of resiliently deformable nubs 91 that act to lock the terminal 6 and stem 92 in position within the channel. The nubs 91 deform when force is applied so that the terminal enters the channel and is prevented from removal unless force is applied.

Advantageously the recessed sections 90 enables a cables to be easily wrapped around a device wherein the rotation/pivoting may be locked at an angle minimising extension of the cable and exposure of the joint, so as to help position the cables and protect the joint when not in use.

The electrical connector shown in FIG. 10 also includes a cap portion 20 that serves to cover a part of the ball portion 2 that would otherwise be exposed so as to protect and conceal all electrical parts in use and acts to allow limited relative movement between body parts or portions.

In some embodiments the cap portion 20 is not included.

In yet further embodiments the socket portion 30 contains a plurality of recess sections, for example four so as to allow extended range of movement in four axes.

The cap portion 20 is dimensioned so as to correspond to a segment of the ball portion 2 whilst allowing the cap portion 20 to rotate into slots in the socket portion 30.

Figure 11:
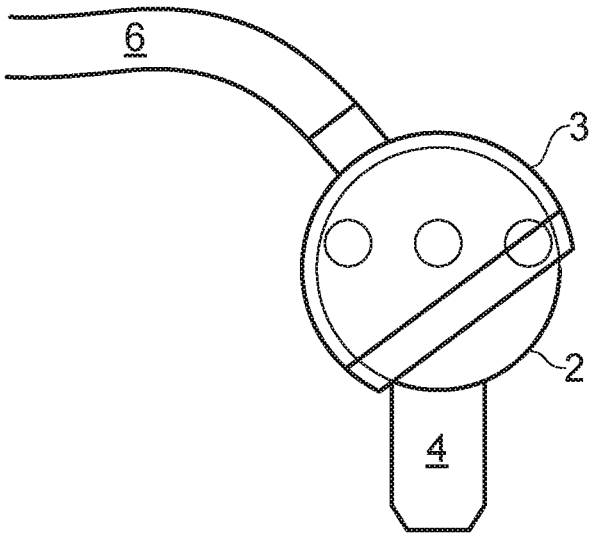
FIG. 11 shows an alternative embodiment of the electrical connector plug having a hemispherical socket, with ball-bearings in recesses rather than grooves.
Figure 12:
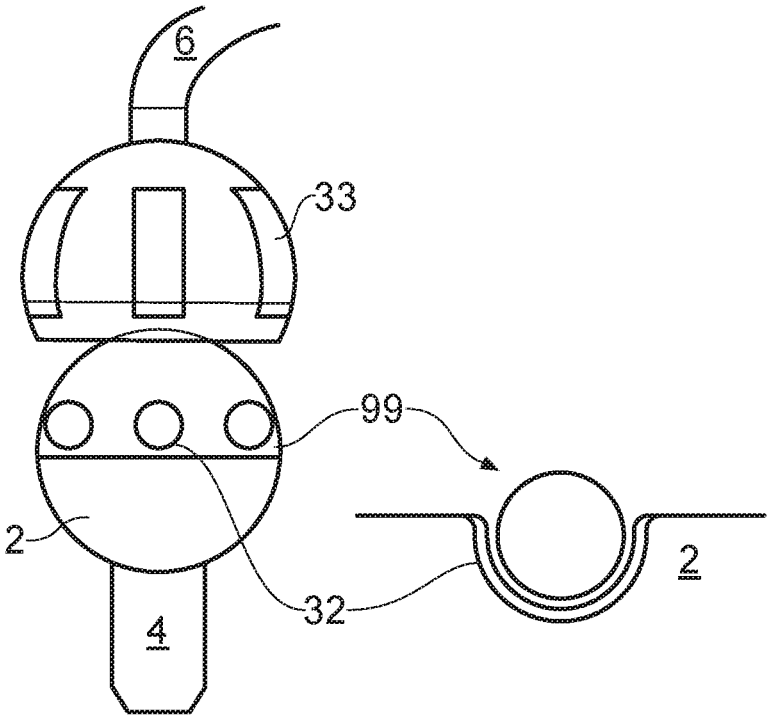
FIG. 12 shows an exploded view of the embodiment shown in FIG. 11.

FIGS. 11 and 12 show a third embodiment of the electrical connector having a ball portion 2 with a plurality of ball-bearings 99 arranged in grooves 33 provided on the surface of the ball socket portion 3 and recesses 32.

The ball-bearings 99 remain fixed within the recesses 32 but are free to rotate.

The socket 3 includes corresponding grooves 33 along which the ball-bearing can move when the socket 3 is moved relative to the ball portion 2.

Figure 13B:
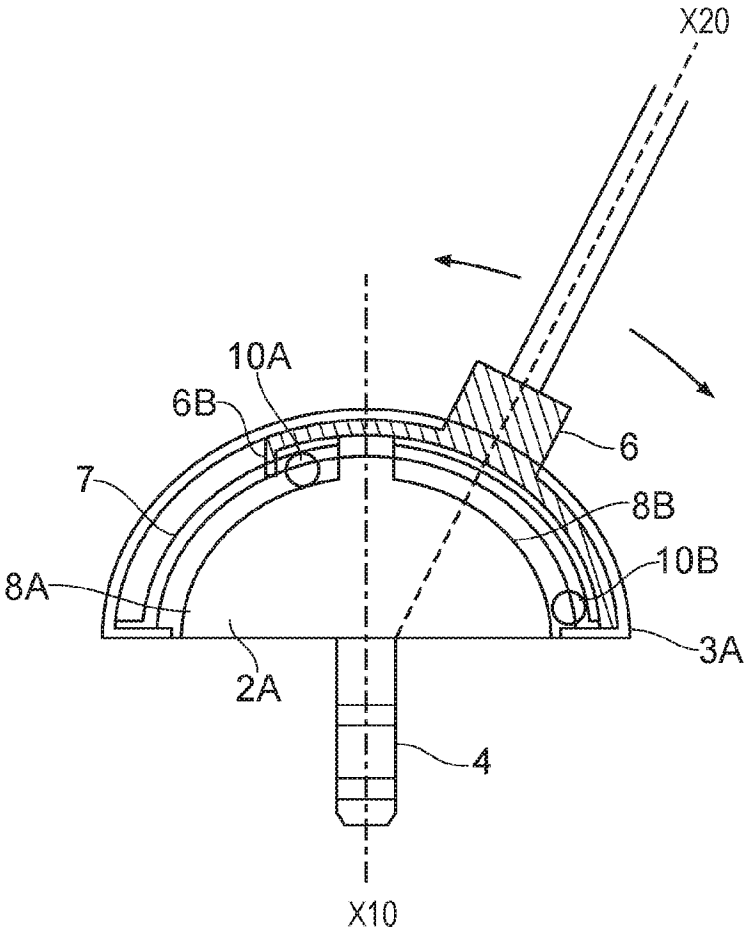
FIG. 13B shows a side view of the embodiment shown in FIG. 13A.
Figure 13A:
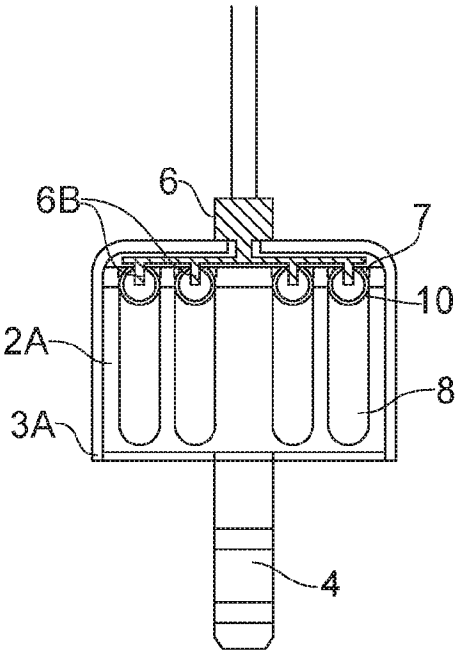
FIG. 13A shows an end view of another embodiment of the electrical connector that permits radial movement in one plane.

FIGS. 13A and 13B show another embodiment of the electrical connector wherein the socket 3A is hemispherical and the ball 2A is also substantially hemispherical. The terminal 6 has wires 6B (indicated by crosshatching) that are associated with the electrical contact 7.

In this embodiment the ball 2A and socket 3A portions do not move relative to each other and instead the terminal is arranged in an elongate channel (not shown) and configured to be in contact with the electrical terminal whilst being moveable along a channel so as to arrange the terminal 6 at different angles X20 relative to the central axis X10.

The male ball portion 2A has eight grooves 8 arranged as four pairs, having four arced grooves 8 on each side of the male ball portion 2A extending from a central axis X10.

There terminal wires 6B are embedded in a member 6A that slides over the electrical contact 7. The terminal wires 6B protrude from an edge of the member 6A, directed towards the grooves 8 so as to provide a hook that catches the ball bearing 10 in use. In this way as the terminal 6 is moved the ball bearings 10 are also moving and a connection is maintained between the corresponding pair of ball bearings 10A, 10B that fit in the corresponding pair of grooves 8A, 8B.

The embodiments of the electrical connector shown in FIGS. 13A and 13B permit radial movement of the terminal in one plane. The arc of movement of the terminal 6 is determined by the position of the ends of the wire 6A. As one end 6A abuts the socket movement is prevented.

The electrical connector 100 has a central axis X10 and the terminal can be positioned at various angles X20 relative to the central axis X10.

In FIG. 13A the member 6A is shown as being as wide as the socket 3A so as to engage with all grooves 8 simultaneously. The wire 6 is a sheet dimensioned to extend across the socket and of a length so as has four hooks 6A at each end to engage with the eight ball bearings 10. Therefore each of the ball bearings 10 provides a separate connection point to the wire in member 6A so as to have eight separate connections points at all times, thereby provide a good electrical connection.

It is appreciated that the ball and socket portions may be greater than or less than a hemisphere so as to alter the range of movement permitted.

Figure 14:
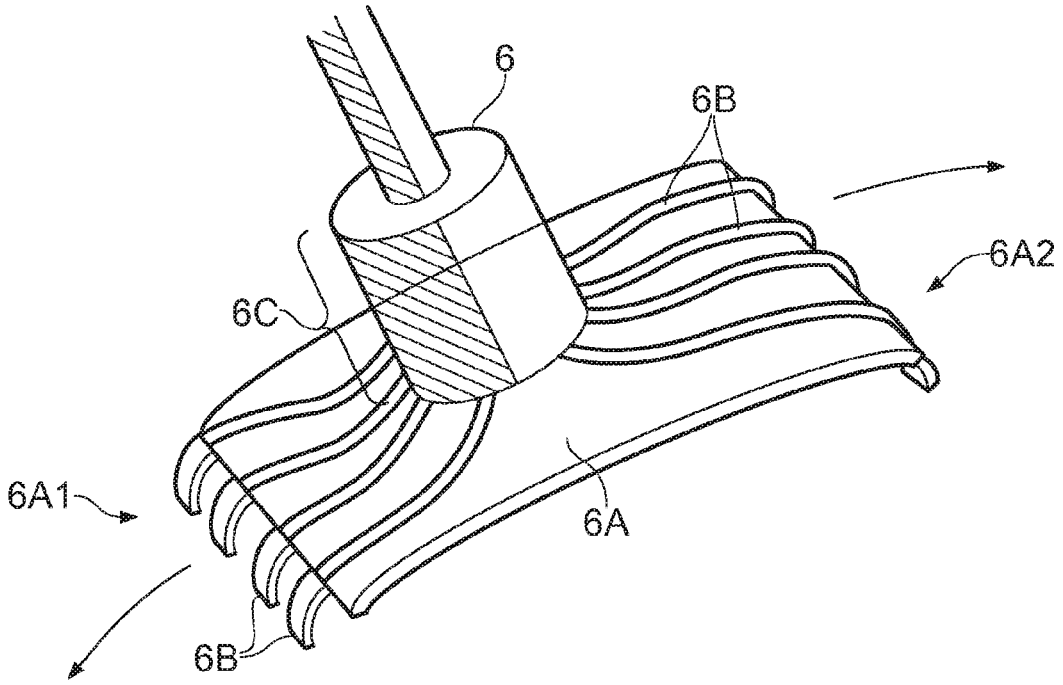
FIG. 14 shows a view of a member with embedded wires from a terminal.

FIG. 14 shows a close up view of the terminal 6 attached to a member 6A that has embedded wires 6B that extend from the terminal 6, through the member 6A and project from the member 6A on an edge 6A1, 6A2 of the member 6A.

The member 6A is a substantially rectangular plate that is curved so as to correspond to the shape of the ball and socket portions of the electrical connector.

The upper and lower faces of the member 6A are smooth so as to permit the member 6A to easily slide in each direction whilst remaining in contact with the electrical contact 7 and the ball bearing s 10.

The member 6A has eight wires 6A extending from the terminal 6, four wires directed to a first edge 6A1 and four wires directed to a second edge 6A2. The edges 6A1, 6A2 correspond to the direction in which the member can be moved through the channel.

The member 6A is formed from a conductive material.

The terminal 6 has a neck 6C which extends through the channel provided in the socket along which the terminal 6 can be moved in a single plane.

The member 6A is engaged with the terminal (not shown in FIG. 14) in use so as to permit an electrical connector 7.

The invention has been described by way of examples only and it will be appreciated that variation may be made to the above-mentioned embodiments without departing from the scope of invention as defined by the claims.

The invention claimed is:

1. An electrical connector, comprising:

a first body part having a first terminal;

a second terminal formed in a second body part having a second terminal;

wherein the first and second body parts are connected and movable with respect one to another thereby permitting variable angles to be defined between an axis of the first terminal and an axis of the second terminal;

wherein the first body part includes at least one groove in an outer surface thereof, wherein the at least one groove is adapted to receive at least one conductive ball bearing, and wherein the at least one groove is lined with a conductive material connected to the first terminal; and wherein the second body part includes at least one electrical contact arranged on an inner surface thereof, wherein said at least one electrical contact is connected to the second terminal; and wherein said at least one electrical contact connects with the at least one conductive ball bearing while located in the at least one groove so as to permit an electrical connection between the first terminal and the second terminal.

2. The electrical connector as claimed in claim 1, wherein the first and second body parts comprise a ball and socket joint.

3. The electrical connector according to claim 1, wherein the first body part comprises a male ball portion and the second body part comprises a female socket portion configured to partially envelop the male ball portion when connected.

4. The electrical connector according to claim 1, wherein the first and second body parts are configured to move relative one to another by pivoting permitting variable angles to be created between the axis defined by the first terminal and the axis defined by the second terminal.

5. The electrical connector according to claim 1, wherein the first and second body parts are configured to move relative one to another by rotating permitting variable angles to be created between the axis defined by the first terminal and the axis defined by the second terminal.

6. The electrical connector according to claim 1, wherein each of the first and second terminals comprises a plug or a socket.

7. The electrical connector according to claim 3, wherein the female socket portion comprises a contact crown having a plurality of elongate electrical contacts, each electrical contact corresponding to one of the at least one groove, and wherein the at least one conductive ball bearing is provided in one of the at least one groove so that the at least one ball bearing moves along the at least one groove so that an electrical contact is maintained during movement of either of the first and second body parts.

8. The electrical connector according to claim 1, wherein the at least one electrical contact is sprung so as to be biased against the at least one ball bearing.

9. The electrical connector according to claim 3, wherein a rim of the female socket portion is planar.

10. The electrical connector according to claim 3, wherein the female socket portion includes at least one recessed section adapted to receive the first terminal.

11. An electrical connector, comprising:

a first body part having a first terminal; and a second body part having a second terminal, wherein the first and second body parts are connected and movable with respect one to another thereby permitting variable angles to be defined between an axis of the first terminal and an axis of the second terminal, wherein the second body part includes at least one groove in an inner surface thereof, wherein the at least one groove is adapted to receive at least one conductive ball bearing, and wherein the at least one groove is lined with a conductive material connected to the first terminal; and wherein the first body part includes at least one electrical contact arranged on an outer surface thereof, wherein said at least one electrical contact is connected to the second terminal, wherein said at least one electrical contact connects with the at least one conductive ball bearing while located in the at least one groove so as to permit an electrical connection between the first terminal and the second terminal.

12. The electrical connector as claimed in claim 11, wherein the first and second body parts comprise a ball and socket joint.

13. The electrical connector according to claim 11, wherein the first body part comprises a male ball portion and the second body part comprises a female socket portion configured to partially envelop the male ball portion when connected.

14. The electrical connector according to claim 11, wherein the first and second body parts are configured to move relative one to another by pivoting permitting variable angles to be created between the axis defined by the first terminal and the axis defined by the second terminal.

15. The electrical connector according to claim 1, further comprising a locking mechanism configured to lock relative movement of the first and second body parts.

16. The electrical connector according to claim 2, wherein the socket joint has an elongate channel through which a terminal extends and which permits movement of the terminal therein.

17. The electrical connector according to claim 11, wherein the first and second body parts are configured to move relative one to another by rotating permitting variable angles to be created between the axis defined by the first terminal and the axis defined by the second terminal.

18. The electrical connector according to claim 11, wherein each of the first and second terminals comprises a plug or a socket.

19. The electrical connector according to claim 13, wherein the male ball portion comprises a plurality of electrical contacts, each electrical contact corresponding to one of the at least one groove, and wherein the at least one conductive ball bearing is provided in one of the at least one groove so that the at least one ball bearing moves along the at least one groove so that an electrical contact is maintained during movement of either of the first and second body parts.

20. The electrical connector according to claim 11, wherein the at least one electrical contact is sprung so as to be biased against the at least one ball bearing.

21. The electrical connector according to claim 13, wherein a rim of the female socket portion is planar.

22. The electrical connector according to claim 13, wherein the female socket portion includes at least one recessed section adapted to receive the first terminal.

23. The electrical connector according to claim 11, further comprising a locking mechanism configured to lock relative movement of the first and second body parts.

24. The electrical connector according to claim 12, wherein the socket joint has an elongate channel through which a terminal extends and which permits movement of the terminal therein.

* * * * *